US006595262B2

(12) United States Patent
Chen

(10) Patent No.: US 6,595,262 B2
(45) Date of Patent: Jul. 22, 2003

(54) ROLL-UP CURTAIN ASSEMBLY FOR PARTITIONING SPACE INTO A PRIVATE AREA

(76) Inventor: Chih-Ming Chen, 4F-3, No. 12, po Kuan Rd., Pei Zone, Taichung (TW)

( * ) Notice: Subject to any disclaimer, the term of this patent is extended or adjusted under 35 U.S.C. 154(b) by 0 days.

(21) Appl. No.: 10/034,126

(22) Filed: Jan. 3, 2002

(65) Prior Publication Data

US 2003/0079843 A1 May 1, 2003

(30) Foreign Application Priority Data

Oct. 25, 2001 (TW) ..... 90126953 A

(51) Int. Cl.[7] ..... E04F 10/06
(52) U.S. Cl. ..... 160/23.1; 160/DIG. 6
(58) Field of Search ..... 160/23.1, 11, 26, 160/290.1, DIG. 6; 4/558, 608, 610

(56) References Cited

U.S. PATENT DOCUMENTS 3,222,689 A * 12/1965 Efron et al. ..... 4/558
3,965,960 A * 6/1976 Massey ..... 160/23.1
4,122,559 A * 10/1978 Kelly ..... 160/23.1
4,821,786 A * 4/1989 Johnston ..... 160/23.1
4,916,764 A * 4/1990 Meaden et al. ..... 4/558
5,231,708 A * 8/1993 Hansen ..... 4/608
5,333,664 A * 8/1994 Sirianni et al. ..... 160/23.1
5,505,244 A * 4/1996 Thumann ..... 160/23.1
5,682,627 A * 11/1997 Russell ..... 4/558
5,732,419 A * 3/1998 Feist ..... 4/558
5,794,281 A * 8/1998 Shearon ..... 4/558
6,267,168 B1 * 7/2001 Davies et al. ..... 160/23.1

* cited by examiner

*Primary Examiner*—David Purol
(74) *Attorney, Agent, or Firm*—Browdy and Neimark, P.L.L.C.

(57) ABSTRACT

A roll-up curtain assembly having an elongated seat frame designed to b e mounted at one lateral side of an entrance of a private area. The seat frame has an elongated opening. A rotatable shaft with a curtain piece roller up on the shaft is received in the seat frame. A reverse assembly is provided to return the curtain piece to the rolled up position after it is released from an extended position. The free end of the curtain piece passes through opening of the seat frame. A stopping device is mounted on the free end of the curtain piece for preventing the curtain piece from being pulled into the seat frame. A first join member is mounted on the stopping device and a second join member to be mounted on the other lateral side opposite from the seat frame of the entrance of the private area to assure closure of the curtain piece.

6 Claims, 5 Drawing Sheets

ROLL-UP CURTAIN ASSEMBLY FOR PARTITIONING SPACE INTO A PRIVATE AREA

FIELD OF THE INVENTION

The present invention relates generally to a curtain, and more particularly to a roll-up curtain assembly for partitioning space into a private area.

BACKGROUND OF THE INVENTION

Some bathroom in hotels or in home, there are a bathtub and an independent shower room. The shower room is usually partitioned by translucent glass and the entrance thereof is pivoted with a shutter or a door plank to prevent water spraying out of the shower room. Some of the shower room provides a slidable curtain or a fold-up shutter, they can be expended to close the entrance when use and can be received at one lateral side of the entrance when not use.

Except the shower room, there are some places need to be partitioned into a private area, such as a changing room. For these rooms, we usually take a shield, a curtain or a shutter to partition them into a temporary private area in a room.

No matter what type of the shade device as described above, they take a larger space to mount them on an entrance of the private area. That will decrease the space in the private area.

SUMMARY OF THE INVENTION

The primary objective of the invention is to provide a roll-up curtain assembly, which has a simpler structure, an easy operating mode and reducing the mounting space.

According to the objective of the invention, the roll-up curtain assembly comprises an elongated seat frame, which is to be mounted at one lateral side of an entrance of a private area. The seat frame has an elongated opening. A shaft receives in the seat frame for free rotating. Means for reversing the shaft back, while the shaft rotating an angle. A curtain piece has one end thereof securing at the shaft then rolled up on the shaft. The free end of the curtain piece passes through opening of the seat frame. A stopping device mounts at the free end of the curtain piece for preventing the curtain piece reversing back in the seat frame, and a join assembly having a first join member and a second join member. The first join member mounts at the stopping device and the second join member mounts at the other lateral side of opposite from the seat frame of the entrance of the private area.

DETAILED DESCRIPTION OF THE INVENTION

Figure 1:
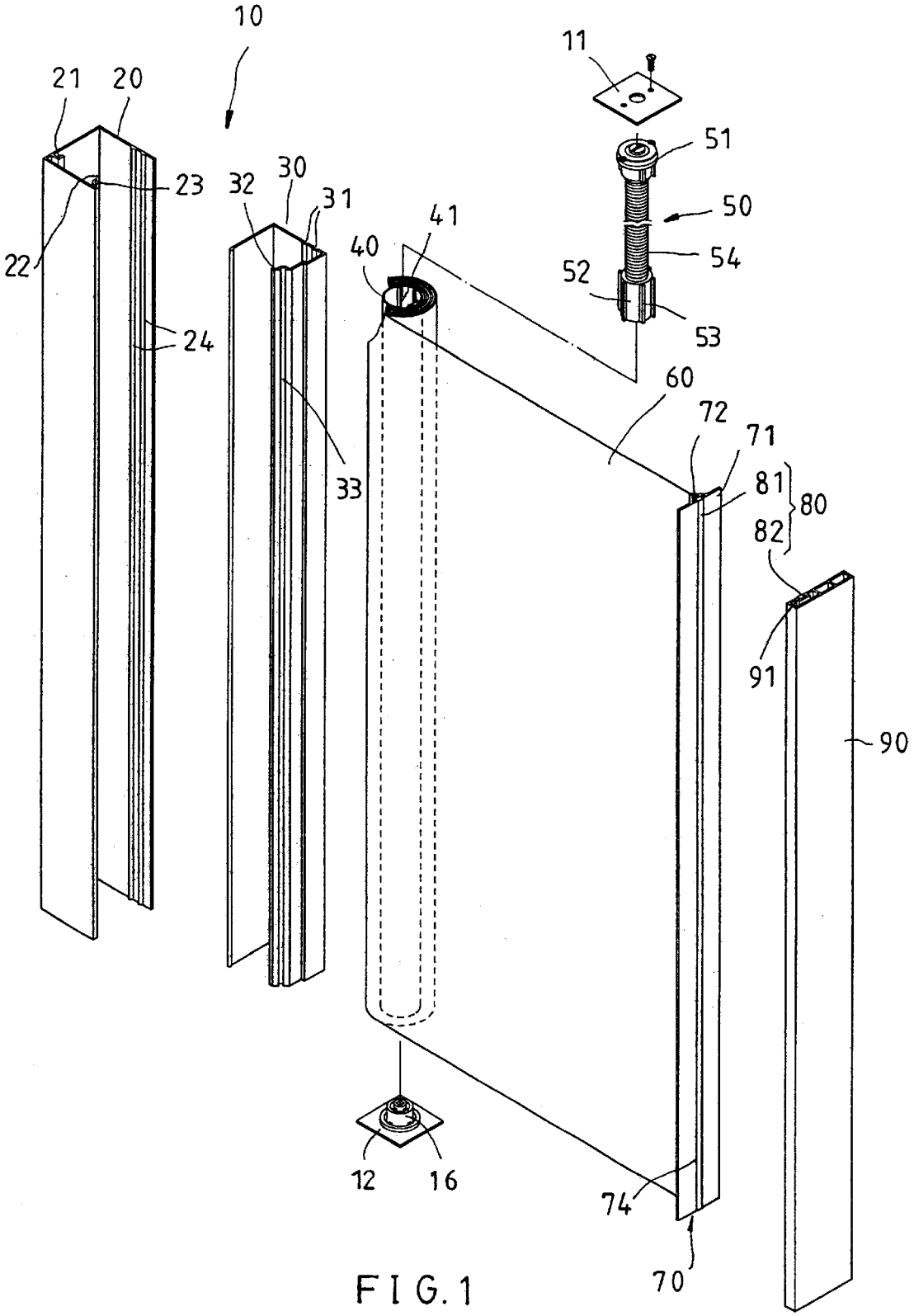
FIG. 1 is an exploded view of a preferred embodiment--of the present invention.
Figure 2:
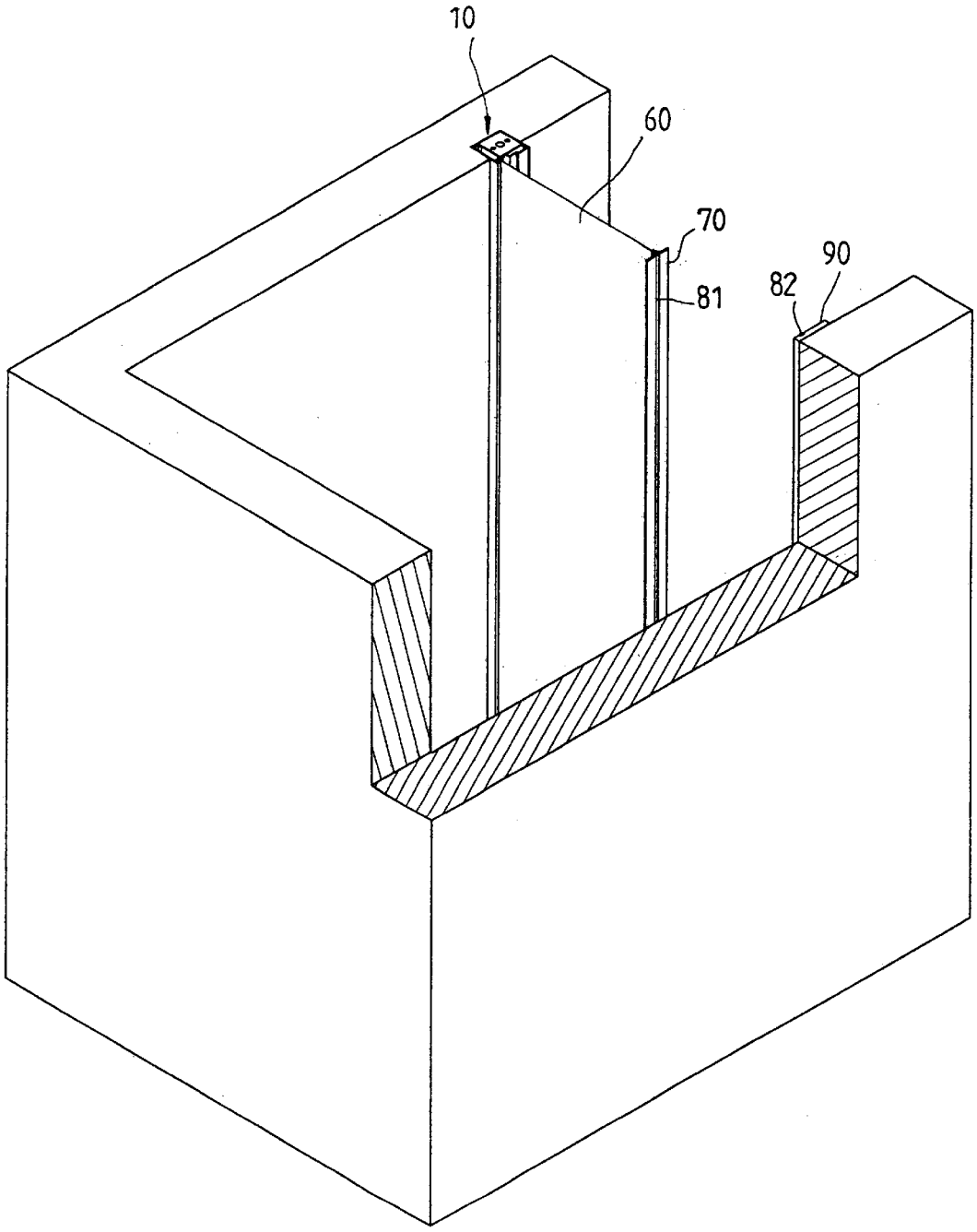
FIG. 2 is the structure sketch of the preferred embodiment, showing the roll-up curtain assembly mounting at the entrance of a private area.

Please refer to FIG. 1 and FIG. 2, the preferred embodiment of the present invention provides a roll-up curtain assembly, which is to be mounted at the entrance of a private area, like the doorframe of a shower room or at the wall of a bathroom corresponding to the bathtub. In this embodiment, we will take the shower room to mount the roll-up curtain assembly of the present invention thereon. The roll-up curtain assembly of the preferred embodiment of the present invention comprises an elongated frame seat 10, a shaft 40 receiving in the frame seat 10 for free rotating, a reverse assembly 50 mounting at the shaft 40, a curtain piece 60 rolled up on the shaft 40, a stopping device 70 mounting at the free end of the curtain piece 60, and a join assembly 80.

Figure 3:
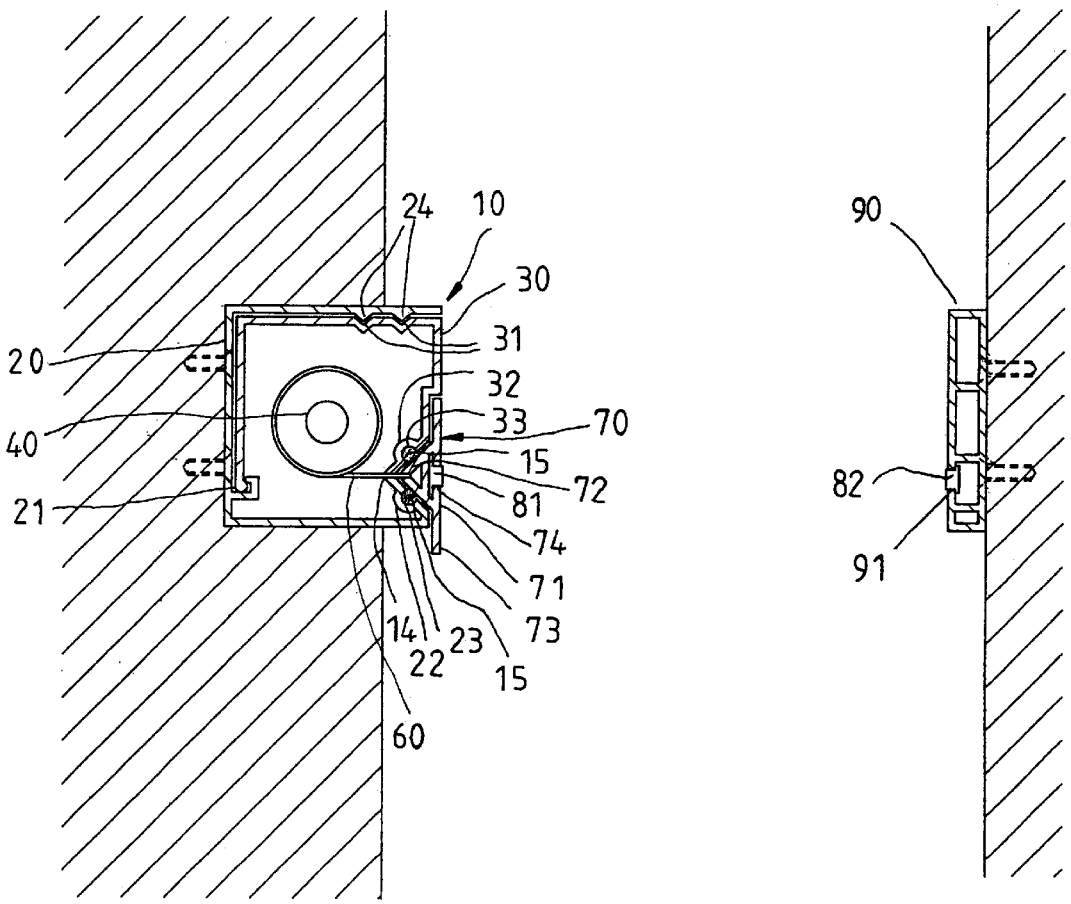
FIG. 3 is the lateral sectional view of the preferred embodiment, showing the curtain piece rolled up.
Figure 4:
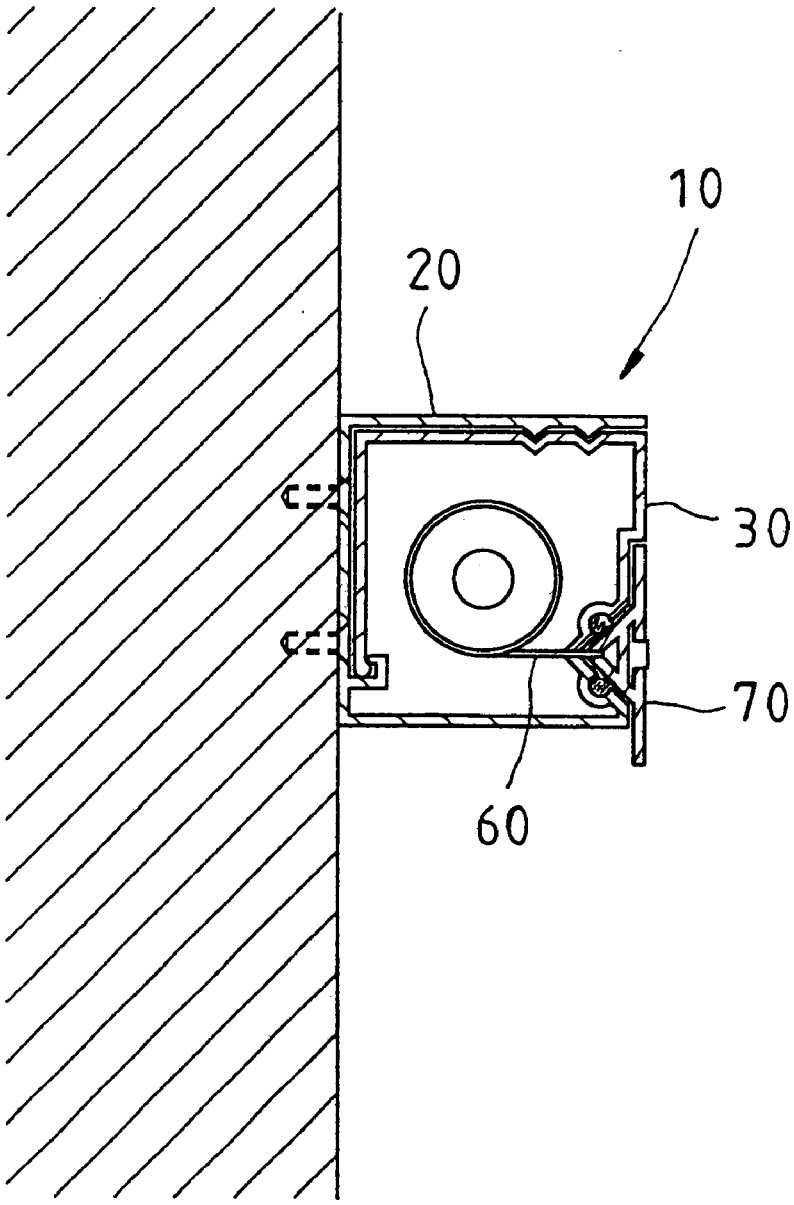
FIG. 4 shows an another way of the frame seat mounting at the entrance of the private area.

The frame seat 10 is to mount at one lateral side of the doorframe of the shower room. The frame seat 10 includes an elongated first frame 20, an elongated second frame 30, a first cover 11 and a second cover 12. The lengths of the first frame 20 and the second frame 30 are substantially equal to the height of the doorframe. The first frame 20 is made from pressing aluminum plank into an element of substantially U-shaped in cross section, which means two elongated sides thereof are bended to a same direction to form two parallel side walls and the midsection thereof forms a base wall. The base wall of the first frame 20 is disposed with a locking slot 21 at the interior side thereof along the elongated axis. The distal end of one side wall of the first frame 20 is bended inward about 45 degrees to form a first bending wall 22. The exterior side of the bending wall 22 has a slot 23 along the elongated axis of the first frame 20. The interior side of the other side wall has two position flanges 24 along the elongated axis thereof. One lateral doorframe of the shower room disposing an elongated slot, please refer to FIG. 3, to receive the first frame 20 therein and the opening end of first frame 20 is orientating to the entrance of the shower room. The first frame 20 is secured in the slot of the doorframe of the shower room by screws. It also can be done by the base wall of the first frame 20 attaching on the doorframe and being secured by screws as shown in FIG. 4. In the second case, there is no need to dispose a slot on the lateral doorframe to simplify the assemble procedure.

The second frame 30 has a shape substantially as same as the first frame 20 having a base wall and two parallel side walls. The second frame 30 receives in the first frame 20 with the opening end thereof orientating to one side wall of the first frame 20 and with the exterior end of the interior side wall of the second frame 30 engaging in the locking slot 21 of the first frame 20. The exterior side of the base wall has two parallel position slots 31 engaging to the position flanges 24 of the first frame 20. The distal end of the exterior side wall of the second frame 30 is bended inward about 45 degrees to form a second bending wall 32. The second bending wall 32, like the first bending wall 22, has a slot 33 at exterior side hereof. An elongated triangular indentation 13 is left at the opening end of the first frame 20 and an elongated opening is left between the distal ends of the first bending wall 22 and the second bending wall 32. Two rubber pieces 15 attach at the exterior sides of the first and second bending walls 22 and 32 respectively and have flanges thereof engaging with the slots 23 and 33 respectively.

The first cover 11 and the second cover 12 secure at the topside and the bottom side of the second frame 30. The second cover 12 has an engage shaft 16 at the interior side thereof.

The shaft 40 is made from pressing aluminum plank into a tube element. The length of the shaft 40 is slightly shorter than the frame seat 10. The shaft 40 has flanges 41 at the interior side thereof. The shaft 40 receives in the interior space of the frame seat 10 with the bottom end thereof engaging to the engage shaft 16 of the second cover 12 for free rotating.

The reverse assembly 50 has a fixed device 51, which is a shaft in the preferred embodiment, having one end thereof securing at the interior side of the first cover 11, and the other end thereof receiving in the shaft 40. A turning member 52 pivots at the free end of the fixed device 51 for free rotating. The turning member 52 has flanges 53 around the outer surface thereof to interfere with the flanges 41 of the shaft 40, such that the shaft 40 and the turning member 52 will turn together. A torsional spring 53 disposes at the outside of the fixed device 51 having one end thereof fixing at the fixed device 51 and the other end thereof fixing at the turning member 52. Thus, when an external force makes the shaft 40 to turn an angle, the reverse assembly 50 can provide the shaft 40 with a reverse force to turn the shaft 40 back to the initial position while the external force is gone.

The curtain piece 60 is made of waterproof material, such as polyvinyl chloride (PVC). The curtain piece 60 is a rectangular piece having a width thereof substantially equal to the length of the shaft 40. One lateral end of the curtain piece 60 fixes at the shaft 40 along the elongated axis of the shaft 40, and then, the curtain piece 60 is rolled up on the shaft 40. The free end of the curtain piece 60 passes through the opening 14 between the first and the second bending walls 22 and 32. The rubber pieces 15 are slightly touch the curtain piece 60.

The stopping device 70 has a length substantially equal to the width of the curtain piece 60, which has a plank segment 71 providing with an elongated slot 74 at one side thereof and a triangular block segment 72 at the other side thereof. The free end of the curtain piece 60 fixes at the edge of the block segment 72 of the stopping device 70. Thus, in the initial position, the block segment 72 is forced to receive in the triangular indentation 13 of the frame seat 10 by the reverse assembly 50 and stopping therein as shown in FIG. 3. One lateral end of the plank segment 71 is left out of the frame seat 10 to form a holding portion 73 for user to hold. When user holds the holding portion 73 to exert the plank segment 71 to pull it out, the curtain piece 60 will extend along with the stopping device 70 to close the entrance of the shower room. When not use, the reverse assembly 50 will forces the curtain piece 60 and the stopping device 70 to turn back to the initial position.

Figure 5:
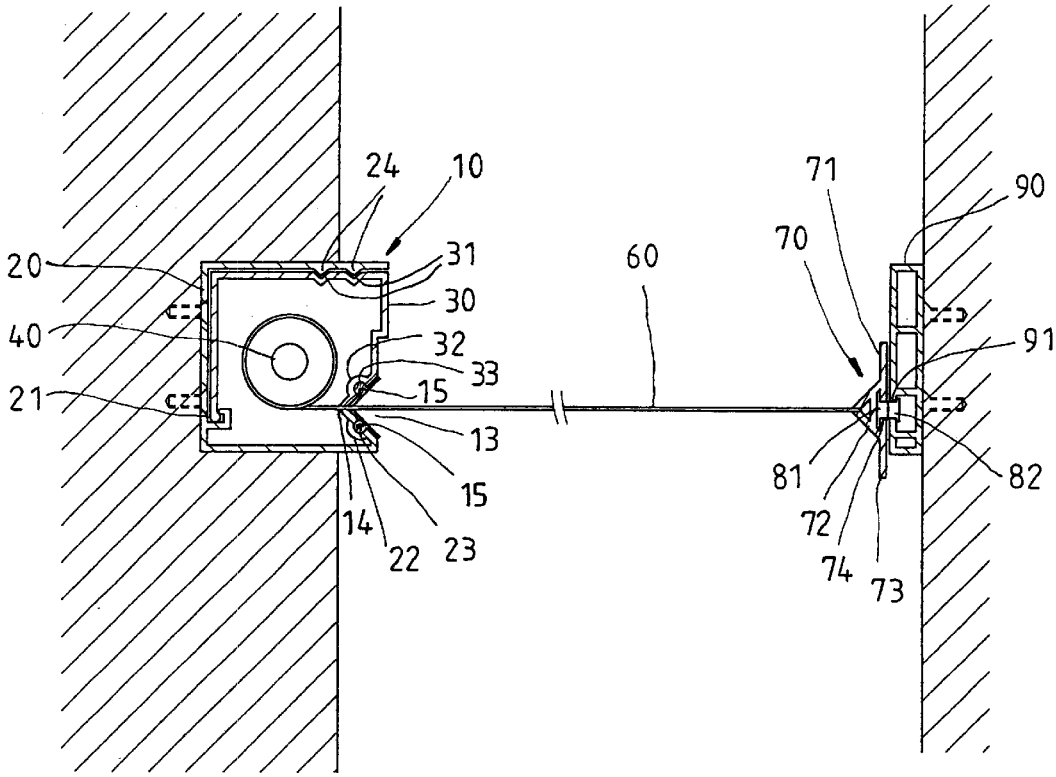
FIG. 5 is the lateral sectional view of the preferred embodiment, showing the curtain piece extended.

The join assembly 80 has a first join member 81 and a second join member 82. In the present embodiment, the first and the second join member 81 and 82 are two elongated soft magnets, one of them 81 is fixed in the slot 74 of the stopping device 70, the other 82 is fixed on a seat plank 90, which is mounted at the doorframe opposite from the seat frame 10. The seat plank 90 has an elongated slot 91 for the second join member 82 receiving and fixing therein. When the curtain piece 60 is pulled out for the first join member 81 attaching on the second join member 82, the magnetic attraction between the first and the second join member 81 and 82 will keep the curtain piece 60 in extending position, as shown in FIG. 5, to close the entrance of the shower room.

Some stuff we have to mention hereunder, to make the specification clearer.

1. The first and the second join member 81 and 82 of the join assembly 80 can be replaced by any type of detachable join assembly, such as a set of hook and ring or a pair of Velcro.

2. The rubber pieces 15 are to block out the water on the curtain piece 60 to keep the interior space of the seat frame 10 dry.

3. For the reverse assembly 50 of the present invention, there were many types of the mechanisms of the reverse assemblies in prior art. In above, we just pick one type of the reverse assembly 50 to describe. However, any type of the reverse assembly in prior art can be used in the present invention.

4. In the detail description, we take the shower room for example to mount the roll-up curtain assembly of the present invention thereon. In practice, the roll-up curtain assembly of the present invention can be set at indoor or outdoor, where need to be partitioned into a private area.

5. In the prefer embodiment, we provide the seat frame 10 with the first frame 20 securing at the doorframe and the second frame 30 engaging in the first frame 20. Whereby user just need to remove the second frame 30 to replace the shaft 40, the reverse assembly 50 and the curtain piece 60.

6. The size, material and pattern of the curtain piece 60 should not be limited within the specification description. We also can pick a translucent material or print pattern on it.

What is claimed is:

1. A roll-up curtain assembly to partition a space into a private area, comprising:

an elongated seat frame adapted to be mounted at a lateral side of an entrance of the private area; said seat frame having an elongated opening along an elongated axis thereof;

a rotatable shaft engaged within said seat frame;

a curtain piece in a rolled up position on the shaft having one end thereof fixed to the shaft; a free end of said curtain piece passing through the opening of said seat frame;

a reverse assembly fixed on said seat frame and engaged to said shaft for returning the curtain piece to the rolled up position after being released from an extended position;

a stopping device mounted on a free end of said curtain piece; a width of said stopping device being larger than the width of said opening of said seat frame to prevent said curtain being pulled into said seat frame by the reverse assembly; said stopping device having a holding portion to assist a user when extending the curtain piece, a join assembly having a first join member and a second join member engageable to said first join member; said first join member mounted on said stopping device and said second join member adapted to be mounted on another lateral side of the entrance of the private area opposite from said seat frame;

wherein said seat frame has an elongated first frame and an elongated second frame; elongated sides of said first frame being bent forming two side walls and a mid-section thereof to form a base wall; said second frame having two side walls and a base wall; the base wall of said first frame adapted to be engaged to the lateral side of the entrance of the private area with an opening end thereof oriented to said entrance; said second frame being received in said first frame with an opening end thereof oriented to one side wall of said first frame;

wherein said first frame has a locking slot on an interior, side of the base wall thereof; a distal end of an interior side wall of said second frame engaged to said locking slot of said first frame; an exterior side of the base wall of said second frame having at least one position slot; an interior side of another side wall of said first frame having at least one position flange engaged to said position slot of said second frame.

2. The roll-up curtain assembly as defined in claim 1, wherein a distal end of the one side wall of said first frame is bent inward to form a first bent wall; a distal end of an exterior side wall of said second frame being bent inward to form a second bent wall corresponding to said first bent wall; an elongated indentation being formed between said first and said second bent wall; said opening of said seat frame being formed between distal ends of said first and said second bent wall; said stopping device having a plank segment and a block segment; said curtain piece fixed to said block segment of said stopping device; said stopping device having an initial position of said block segment thereof received in said indentation of said seat frame and stopping therein when the curtain piece is in the rolled up position; a side holding portion located at one side of said plank segment.

3. The roll-up curtain assembly as defined in claim 1, wherein said reverse assembly comprises a fixed device fixed at one end to said seat frame, a turning member rotatable on the fixed device and a torsional spring having one end fixed to said fixed device and another end fixed to said turning member.

4. The roll-up curtain as defined in claim 3, wherein said shaft is tube-shaped; said fixed device being shaft-shaped and having one end thereof inserted into said shaft, another end thereof fixed to said seat frame; said turning member being received in said shaft and engaged with said shaft; said spring providing on said fixed device.

5. The roll-up curtain assembly as defined in claim 1, wherein said curtain is made of waterproof material; two rubber pieces respectfully mounted on said seat frame at opposite sides of said opening to block water from entering the seat frame.

6. The roll-up curtain assembly as defined in claim 1, further comprising a seat plank adapted to be mounted on the other lateral side of the entrance of the private area parallel to said seat frame; said second join member of said join assembly adapted to be mounted on at said seat plank; said first and said second join members of said join assembly being two magnets.

* * * * *